United States Patent [19]

Spreadbury et al.

[11] 4,286,207

[45] Aug. 25, 1981

[54] HIGH-POWER AC VOLTAGE STABILIZER

[75] Inventors: Robert J. Spreadbury, Murrysville; James M. Banic, Jr., Greenville, both of Pa.

[73] Assignee: Westinghouse Electric Corp., Pittsburgh, Pa.

[21] Appl. No.: 140,054

[22] Filed: Apr. 14, 1980

[51] Int. Cl.[3] ..... G05F 1/26

[52] U.S. Cl. ..... 323/263

[58] Field of Search ..... 323/45, 57

[56] References Cited

U.S. PATENT DOCUMENTS

| | | | |
|---|---|---|---|
| 2,839,719 | 6/1958 | Artzt | 323/45 |
| 3,129,380 | 4/1964 | Lichowsky | 323/45 |
| 3,201,683 | 8/1965 | Hjermstad et al. | 323/45 |
| 3,281,654 | 10/1966 | Reinert | 323/45 |
| 3,344,341 | 9/1967 | Bolton . | |
| 3,408,558 | 10/1968 | Peterson et al. . | |
| 3,419,788 | 12/1968 | May . | |
| 3,435,331 | 3/1969 | Bixby . | |
| 3,474,327 | 10/1969 | Logan . | |
| 3,490,030 | 1/1970 | Kelly, Jr. . | |
| 3,571,698 | 3/1971 | McCabe . | |
| 3,596,172 | 7/1971 | Harrison . | |
| 3,599,037 | 8/1971 | Grace | 323/45 UX |
| 3,601,686 | 8/1971 | Gautherin . | |
| 3,621,375 | 11/1971 | Kettler | 323/45 X |

FOREIGN PATENT DOCUMENTS 401980 2/1974 U.S.S.R. .

*Primary Examiner*—William M. Shoop
*Attorney, Agent, or Firm*—E. L. Pencoske

[57] ABSTRACT

An injection transformer has a primary winding series connected with a pair of inverse parallel-connected thyristors between a pair of input terminals. A control circuit is connected across a pair of output terminals for firing the thyristors. The injection transformer has a secondary winding connected between one of the input terminals and one of the output terminals for producing an injection voltage. A filter has components presenting a high impedance to the harmonic frequencies of the injection voltage and a low impedance to the fundamental frequency of the injection voltage, and has components presenting a high impedance to the fundamental frequency of the injection voltage and a low impedance to the harmonic frequencies of the injection voltage. The filter is connected such that the flow of current through the thyristors is limited, the harmonic frequencies are attenuated, and the fundamental frequency is added vectorially to an AC source voltage connectable at the input terminals thus providing a filtered, regulated, AC voltage across the output terminals.

11 Claims, 7 Drawing Figures

HIGH-POWER AC VOLTAGE STABILIZER

BACKGROUND OF THE INVENTION

1. Field of the Invention

The present invention is related generally to voltage regulators and more specifically to AC voltage stabilizers capable of providing a voltage regulated to within desired limits at high-power levels.

2. Description of the Prior Art

With the proliferation of input voltage-sensitive loads, such as computers, there is an increasing demand for AC line voltage stabilizers. These devices are connected between the utility line and the voltage-sensitive load. They typically provide a ±1% output or load voltage from a ±17% input or utility voltage.

For loads up to approximately 20 KVA there is a number of methods for providing the required stabilization. The vast majority of applications can be satisfied using a constant voltage transformer or one of its derivatives. However, for powers up to the 500 KVA range the constant voltage transformer is no longer viable. Alternative methods such as motor alternator sets are expensive, heavy, and pose special siting and maintenance problems. Other methods such as motor-driven variacs are generally too slow in operation; tap changing transformers may not provide sufficiently tight control.

Several static methods are available for providing the required regulation. Representative of these is U.S. Pat. No. 3,435,331. Disclosed therein is a voltage regulator utilizing a gapped booster transformer and a gapped filter transformer each having a winding comprised of a first and second portion. The first portion of each of the windings of the two transformers is connected in series with the source and the load. The first and second portions of the winding of the filter transformer are connected in series with a harmonic filter circuit across the turns of the booster transformer. The conduction of current through the second portion of the booster transformer is controlled by a pair of inverse parallel-connected silicon control rectifiers. The rectifiers are fired by a control circuit. This patent is characteristic of the prior art in that little or no protection is provided for the silicon control rectifiers by way of limiting the current flowing therethrough. It is also characteristic of the prior art in its use of harmonic filters for filtering the output wave form.

SUMMARY OF THE INVENTION

The present invention is an apparatus for stabilizing an AC voltage at high-power levels. An injection transformer has a primary winding and a secondary winding. The flow of current through the primary winding is controlled by a pair of inverse parallel-connected thyristors which are fired by a control circuit. The secondary winding produces an injection voltage that is filtered by a novel three component filter. The filter has components presenting a high impedance to the harmonic frequencies of the injection voltage and a low impedance to the fundamental frequency of the injection voltage. The filter further has components presenting a high impedance to the fundamental frequency of the injection voltage and a low impedance to the harmonic frequencies of the injection voltage. The filter is connected such that the harmonic frequencies are attenuated, the fundamental frequency is vectorially added to the AC source voltage thus providing the necessary voltage stabilization, and the flow of current through the thyristors is limited. The present invention thus eliminates the need for harmonic filters so often encountered in the prior art. The present invention also provides overcurrent protection for the thyristors which is often lacking in the prior art or is provided in the prior art by elaborate peak voltage suppression circuits or the like. These and other advantages are discussed in detail hereinbelow.

DESCRIPTION OF THE PREFERRED EMBODIMENT

Figure 1:
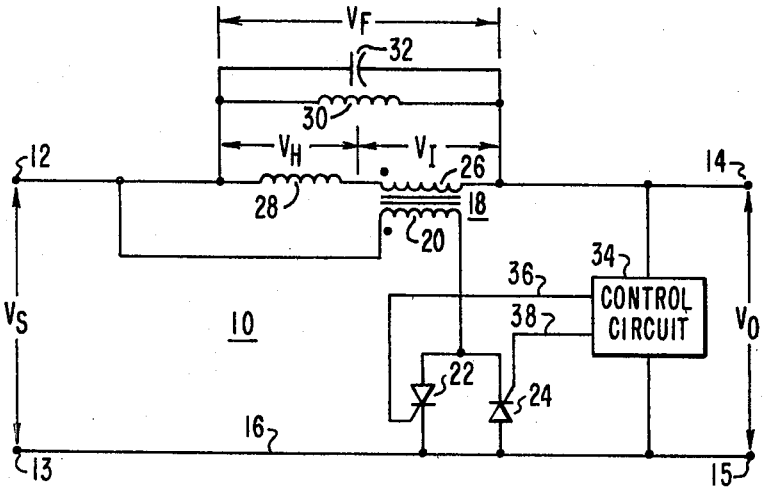
FIGS. 1 and 2 are electrical schematics of an AC voltage stabilizer constructed according to the teachings of this invention which are capable of boosting an AC source voltage.

FIG. 1 is an electrical schematic of an AC voltage stabilizer 10 constructed in accordance with the present invention. The AC voltage stabilizer 10 has a pair of input terminals 12 and 13 adapted for connection to a source of high-power AC voltage, not shown. The AC voltage source provides a source voltage $V_S$ which may vary by as much as 17%. The AC voltage stabilizer 10 has a pair of output terminals 14 and 15 adapted for connection to an input voltage-sensitive load, not shown. Available at the output terminals 14 and 15 is an output voltage $V_O$ which will not vary by more than 1%. The input terminal 13 is connected to the output terminal 15 by a conductor 16.

The AC voltage stabilizer 10 has an injection transformer 18 having a primary winding 20 and a secondary winding 26. The primary winding 20 is connected at one end to the input terminal 12 and is connected at the other end to the conductor 16 through a pair of inverse parallel-connected thyristors 22 and 24. The secondary winding 26 is connected at one end to the input terminal 12 through an inductor 28 and is connected at the other end to the output terminal 14. A second inductor 30 connected in parallel with a capacitor 32 is connected in parallel with the series combination of the inductor 28 and the secondary winding 26. The inductor 28, the inductor 30, and the capacitor 32 form a filter 40.

A control circuit 34 is connected between the output terminals 14 and 15. The control circuit 34 is connected to the thyristor 22 through a conductor 36 and is connected to the thyristor 24 through a conductor 38. The control circuit 34 and the thyristors 22 and 24 may be a commercially available unit such as Vectrol Inc.'s proportional controller type number VPAC 506-240-15A.

In operation the control circuit 34 monitors the output voltage $V_O$ available at the output terminals 14 and 15. When the output voltage $V_O$ deviates from a predetermined value the control circuit 34 will produce control pulses to fire one of the thyristors 22 or 24. The thyristors 22 and 24 are commutated naturally. When one of the thyristors 22 or 24 receives a control pulse it will become conductive allowing current to flow through the primary winding 20. The thyristors thus act as a bidirectional switch. The method of firing the thyristors 22 and 24 is recognized in the art as phase-back gating. When current flows through the primary winding 20 an injection voltage $V_I$ (shown in FIG. 1) appears across the secondary winding 26. The injection voltage $V_I$ may be added to boost the source voltage $V_S$ or subtracted to buck the source voltage $V_S$ by proper connection of the secondary winding 26. The injection voltage $V_I$ in FIG. 1 will be added to the source voltage $V_S$ as illustrated by the dots on the primary and secondary windings 20 and 26, respectively.

It is recognized in the art that under normal load conditions the injection voltage $V_I$ is not in phase with the source voltage $V_S$. For this reason the AC voltage stabilizer 10 will have a sufficient controllable range under normal load conditions even though the voltage stabilizer 10 is capable of only boosting the source voltage $V_S$.

Figure 2:
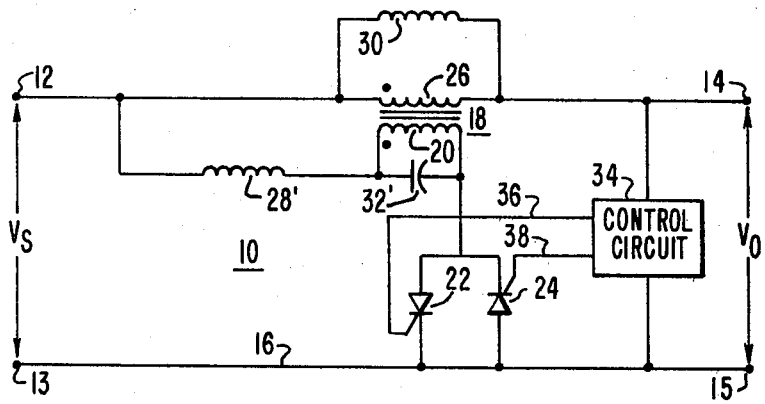

Referring to FIG. 2 an alternative embodiment is shown. The embodiment shown in FIG. 2 is electrically equivalent to the embodiment shown in FIG. 1. The difference in appearance is due to the fact that in FIG. 1 the inductor 28 and the capacitor 32 are located on the secondary side of the injection transformer 18 whereas in FIG. 2 they are located on the primary side of the injection transformer 18. In FIG. 2 the inductor is referenced by numeral 28' and the capacitor is referenced by numeral 32' to highlight the fact that in transferring from the secondary to the primary side of the injection transformer 18 the value of the components has been changed by a fixed amount. However, as noted earlier, the function of the components has not changed. In FIG. 2 it can be seen that the inductor 28' limits the current flowing through the thyristors 22 and 24. The inductor 28' therefore provides overcurrent protection for the thyristors 22 and 24, which is an important feature of the present invention.

Figure 3:
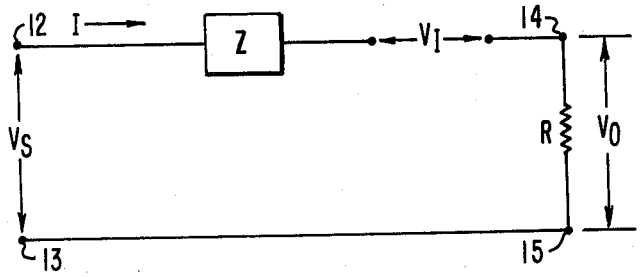
FIG. 3 is a simplified electrical schematic of FIGS. 1 and 2 wherein the filter shown in FIGS. 1 and 2 is replaced by an equivalent impedance.

Turning now to FIG. 3, a simplified electrical schematic is shown wherein the inductor 28, the inductor 30, and the capacitor 32 have been replaced by an equivalent impedance Z; the injection voltage $V_I$ is shown separated from the above mentioned components; a resistive load R is connected across the output terminals 14 and 15. A current I flows through the circuit. A vector diagram showing the addition of the voltages of FIG. 3 is found in FIG. 4.

Figure 4:
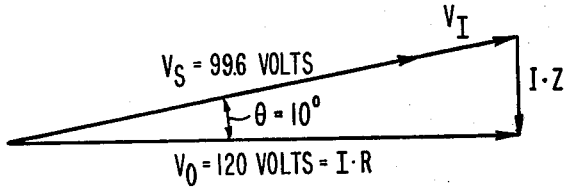
FIG. 4 is a vector diagram illustrating the vector addition of the voltages of FIG. 3.

In FIG. 4 the voltage stabilizer 10 is assumed to be operating at full boost, i.e. the source voltage is at a minimum of 99.6 volts, the output voltage $V_O$ is a constant 120 volts, and the load is 100 ohms. In order to determine the equivalent impedance Z, which is an important design criteria, the maximum acceptable phase shift $\theta$ between the source voltage $V_S$ and the output voltage $V_O$ must be chosen. In this example $\theta$ equals 10°. Using ohms law, $$V_O = I \cdot R$$

$$120 \text{ volts} = I \cdot 100\Omega$$

$$I = 1.2 \text{ amps} \tag{1}$$

and a trigonometric function, $$V_O \cdot \tan\theta = I \cdot Z$$

$$120 \text{ volts} \cdot \tan 10° = 1.2 \text{ amps} \cdot Z$$

$$Z = 17.63\Omega \tag{2}$$

the equivalent impedance Z is calculated to be 17.63 ohms.

Figure 5:
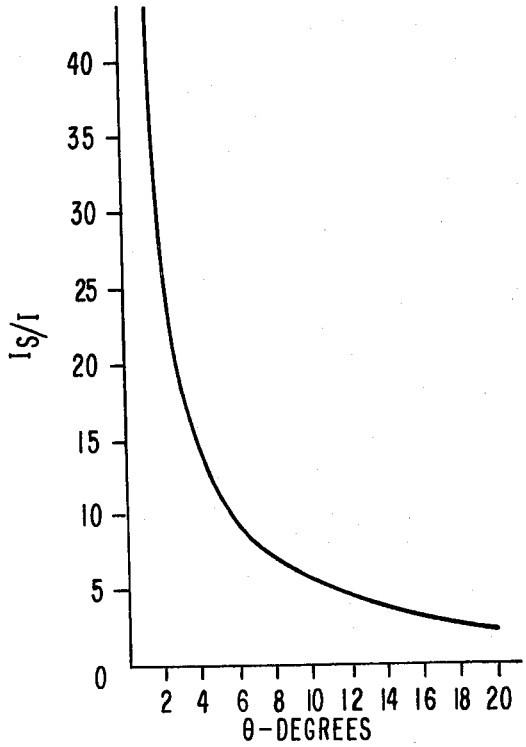
FIG. 5 is a graph of the ratio of the short circuit current to the full load current as a function of the phase shift between the input voltage and the output voltage.

After determining the value of the equivalent impedance Z, the value of the inductor 28 is calculated by determining the ratio of the short circuit current $I_S$ to the full load current I. Turning to FIG. 5 the ratio is plotted as a function of the phase angle $\theta$. For a phase angle of 10° the ratio $I_S/I$ is 5.5 to 1. From equation (1) the full load current I is 1.2 amps. The impedance of the inductor 28 is therefore, $$Z_{28} = V_S/I_S \text{ nominal}$$

$$Z_{28} = 120 \text{ volts}/(5.5)\ (1.2 \text{ amps})$$

$$Z_{28} = 18.18\Omega \tag{3}$$

At a frequency of 60 Hz the inductor 28 has a value of, $$L_{28} = Z_{28}/w$$

$$L_{28} = 18.18\Omega/2 \cdot \pi \cdot 60$$

$$L_{28} = 48.23 * 10^{-3} \text{ henries} \tag{4}$$

where w = angular frequency = $2 \cdot \pi \cdot$ frequency (cycles/sec.)

Having determined the value $L_{28}$ of the inductor 28 the values of the remaining components may be determined by characterizing the filter 40 in one of two ways. It may first be characterized, as before, as a total impedance Z seen by the source voltage $V_S$. The total impedance is calculated from the parallel connection of inductor 30, capacitor 32, and inductor 28. This provides the equation, $$\frac{1}{Z} = \frac{1}{jwL_{28}} + \frac{1}{jwL_{30}} + jwC_{32} \tag{5}$$

or $$Z = \frac{-w^2 L_{28} L_{30}}{jw[L_{30} \cdot (1 - w^2 L_{28} C_{32}) + L_{28}]}$$

where Z equals 17.63 ohms from equation (2) and $L_{28}$ equals $48.23 * 10^{-3}$ henries from equation (4).

The filter 40 may also be characterized as the impedance seen by the injection voltage $V_I$. In this characterization the inductor 28 is in series with the parallel combination of the inductor 30 and the capacitor 32. The inductor 30 and the capacitor 32 are chosen such that their parallel combination presents a high impedance to the fundamental frequency of the injection voltage $V_I$ and a low impedance to the harmonic frequencies of the injection voltage $V_I$. A voltage drop $V_F$ (shown in FIG. 1) across the parallel combination of the inductor 30 and the capacitor 32 is therefore due primarily to the fundamental frequency of the injection voltage $V_I$. Conversely, the inductor 28 presents a high impedance to the harmonic frequencies of the injection voltage $V_I$ and a low impedance to the fundamental frequency of the injection voltage $V_I$. A voltage drop $V_H$ (shown in FIG. 1) across the inductor 28 in therefore due primarily to the harmonic frequencies of the injection voltage $V_I$. Mathematically, $$jwL_{28} << \frac{jwL_{30} \cdot \frac{1}{jwC_{32}}}{jwL_{30} + \frac{1}{jwC_{32}}} \quad (6)$$

or $$L_{28} << \frac{L_{30}}{1 - w^2 L_{30} C_{32}}$$

where $L_{28}$ equals $48.23*10^{-3}$ henries from equation (4). In this manner the voltage drop $V_F$, representative of the fundamental frequency of the injection voltage $V_I$, is vectorially added to the source voltage $V_S$ thus eliminating the need for harmonic filters. This is an important feature of the present invention.

Using either equation (5) or equation (6) a convenient value for either inductor 30 or capacitor 32 may be chosen and the remaining value calculated. Using equation (6), setting the parallel combination of the inductor 30 and the capacitor 32 to be ten times greater than the inductor 28, and setting $L_{30}$ equal to $L_{28}$, $$10 \cdot 48.23*10^{-3} = 48.23*10^{-3}/1 - (2 \cdot \pi \cdot 60 \cdot)^2 \cdot 48.23*10^{-3} \cdot C_{32}$$

$$C_{32} = 131.3\mu \text{ Farads} \quad (7)$$

The above analysis provides values for the inductor 28, the inductor 30, and the capacitor 32. Those skilled in the art will recognize that different assumptions may be made. For example, the load current I could be fixed rather than the load resistance R, the ratio of short circuit current to full load current $I_S/I$ could be fixed rather than the maximum phase shift $\theta$ between the source voltage $V_S$ and the output voltage $V_O$, or a convenient value for the capacitor 32 may be chosen rather than the inductor 30. The above analysis is somewhat simplified since it does not consider the voltage amplification, or attenuation, of the injection voltage $V_I$ when the voltage stabilizer 10 is used in a closed loop system.

Figure 6:
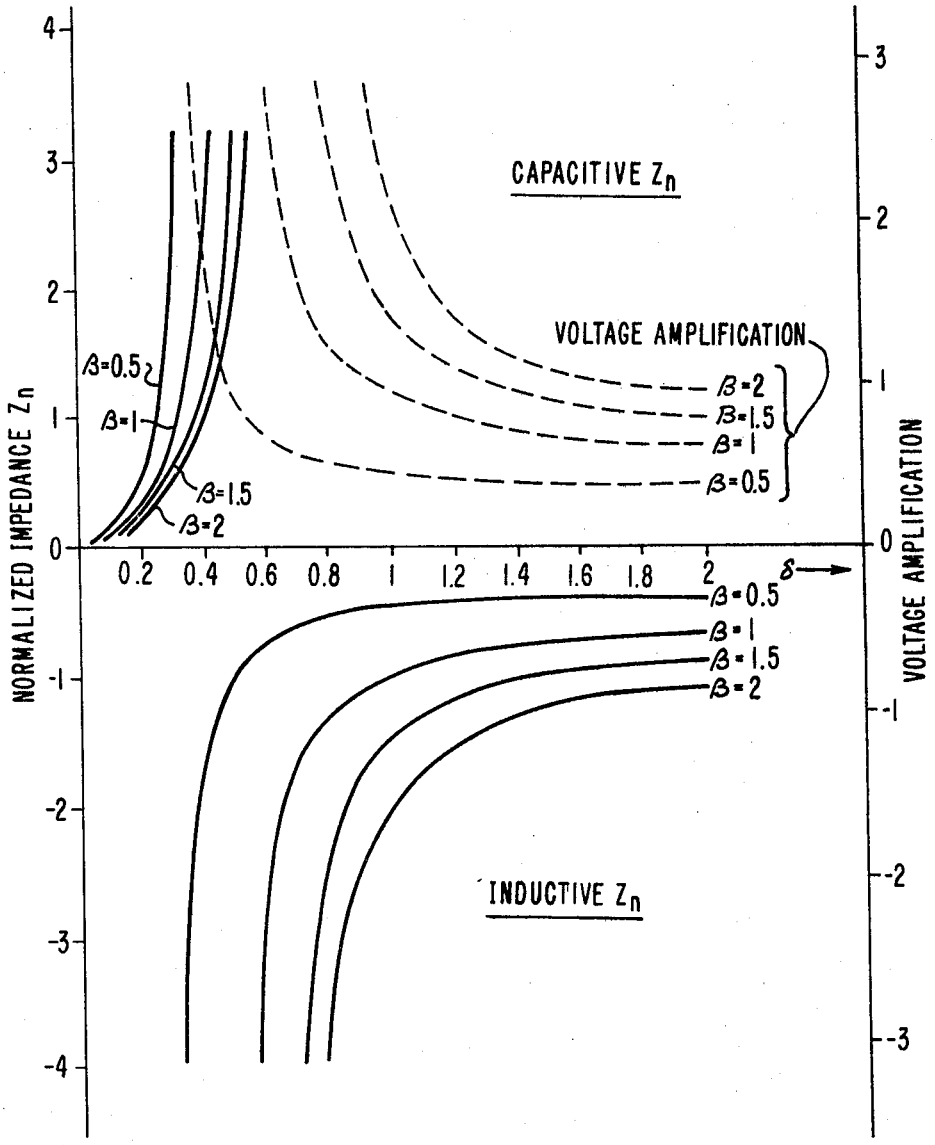
FIG. 6 is a graph of both the normalized impedance and the amplification of the injection voltage as functions of $\beta$ and $\delta$.

Turning now to FIG. 6 there is shown a graph of the normalized impedance $Z_n$ and the amplification of the injection voltage $V_I$ as a function of $\beta$ and $\delta$ where the normalized impedance is the equivalent impedance Z divided by the impedance $Z_{28}$ of the inductor 28, or $Z_n = Z/Z_{28}$; $\beta$ equals the value of the inductor 30 divided by the value of the inductor 28, or $\beta = L_{30}/L_{28}$; $\delta$ equals the impedance of the capacitor 32 divided by the impedance of the inductor 28, or $\delta = Z_{32}/Z_{28}$. The inductor 30 and the capacitor 32 are a tuned circuit. Below the resonant frequency their parallel impedance is predominately capacitive, at the resonant frequency their parallel impedance is infinite, and above the resonant frequency their parallel impedance is predominately inductive. At low values of $\delta$, below $\delta = 1$, the normalized impedance is initially capacitive, quickly goes to infinity, then becomes inductive, all with attendant large amplification of the injection voltage $V_I$. It is therefore desirable to choose values for $\beta$ and $\delta$ such that the normalized impedance will be predominately inductive and the amplification of the injection voltage will be constant.

Returning to our example where the load is 100 ohms and the maximum acceptable phase shift $\theta$ between the source voltage $V_S$ and the output voltage $V_O$ is ten degrees, the equivalent impedance Z was calculated to be 17.63 Ω (equation 2) and the value $L_{28}$ of the inductor 28 was calculated to be $48.23*10^{-3}$ henries (equation 4). Calculating the normalized impedance, $$Z_n = Z/Z_{28}$$

$$Z_n = 17.63\Omega/18.18\Omega$$

$$Z_n = 0.97 \quad (8)$$

Having calculated the normalized impedance $Z_n$ we may now choose a value for $\delta$ (or $\beta$) and locate the value for $\beta$ (or $\delta$) from FIG. 6. At $Z_n = 0.97$ let $\beta = 1$, therefore $\delta = 1.37$. Since $$\beta = 1 = L_{30}/L_{28}$$

$$1 = L_{30}/48.23*10^{-3}$$

$$L_{30} = 48.23*10^{-3} \text{ henries} \quad (9)$$

and $$\delta = 1.37 = Z_{32}/Z_{28}$$

$$0.73 = (2\pi 60)^2 \cdot C_{32} \cdot 48.23*10^{-3}$$

$$106.5*10^{-6} \text{ farads} = C_{32}$$

$$106.5\mu \text{ farads} = C_{32} \quad (10)$$

Turning finally to the calculation of the turns ratio of the injection transformer 18 the magnitude of the injection voltage $V_I$ may be calculated from the vector diagram of FIG. 4. From FIG. 4, $$(V_S + V_I) \cdot \cos\theta = V_O$$

$$(99.6 \text{ volts} + V_I) \cos 10° = 120 \text{ volts}$$

$$V_I = 22.25 \text{ volts} \quad (11)$$

The magnitude of the injection voltage $V_I$ is used to calculate the voltage across the secondary $V_2$, which must be slightly larger than the injection voltage to account for attenuation, $$V_2 = V_I(\beta - \delta - \delta\beta)/-\delta\beta$$

$$V_2 = 22.25 \text{ volts } (1 - 1.42 - 1.42)/-1.42$$

$$V_2 = 28.83 \text{ volts} \quad (12)$$

The turns ratio n is calculated by knowing that the voltage across the secondary $V_2$ must be 28.83 volts even when the voltage across the primary $V_1$, which is the source voltage $V_S$, is at a minimum of 99.6 volts, or $$n = V_1/V_2$$

$$n = 99.6/28.83$$

$$n = 3.45/1 \quad (13)$$

This concludes the discussion of the calculation of the values for the components of the A.C. voltage stabilizer 10.

Figure 7:
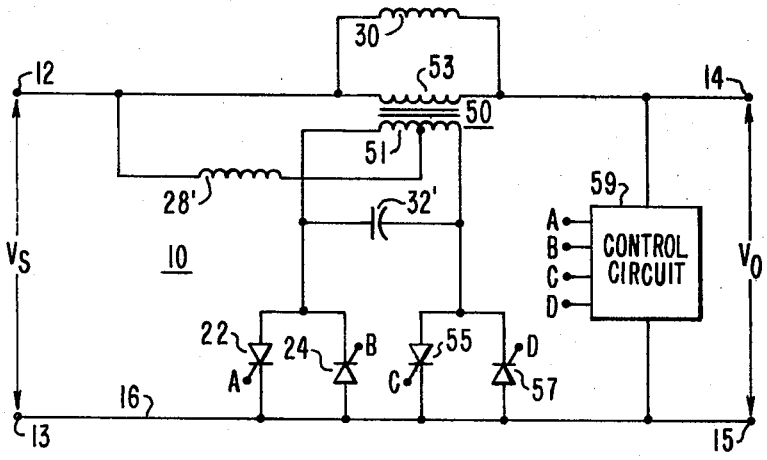
FIG. 7 is an electrical schematic of an AC voltage stabilizer constructed according to the teachings of this invention which is capable of bucking and boosting an AC source voltage.

Referring to FIG. 7 another alternative embodiment is shown. The AC voltage stabilizer 10 of FIG. 7 is capable of bucking and boosting the source voltage $V_S$.

This is accomplished by replacing the injection transformer 18 of FIG. 5 with an injection transformer 50. The injection transformer 50 has a primary winding 51 having an intermediate tap and a secondary winding 53. The intermediate tap is connected to the input terminal 12 through the inductor 28'. One end of the primary winding 51 is connected to the conductor 16 through the inverse parallel-connected thyristors 22 and 24. The other end of the primary winding 51 is connected to the conductor 16 through a second pair of inverse parallel-connected thyristors 55 and 57. A control circuit 59, connected between the output terminals 14 and 15, produces control pulses available at output terminals A, B, C, and D for firing the thyristors 22, 24, 55, and 57, respectively. When one of the thyristors 22 or 24 is conductive the injection voltage will buck the source voltage $V_S$. When one of the thyristors 55 or 57 is conductive the injection voltage will boost the source voltage $V_S$. It is anticipated that additional embodiments may be constructed which fall within the scope of the present invention.

What is claimed is:

1. An apparatus for stabilizing an AC voltage at high-power levels, comprising:

a pair of input terminals adapted for connection to a source of AC voltage;

a pair of output terminals adapted for connection to an input voltage-sensitive load, one of said output terminals connected to one of said input terminals;

an injection transformer having a primary winding and a secondary winding, said secondary winding producing an injection voltage having a fundamental frequency, said secondary winding connected between the other one of said input terminals and the other one of said output terminals;

control means connected between said output terminals;

bidirectional switching means responsive to said control means and series connected with said primary winding between said input terminals;

and filter means limiting the current flowing through said switching means and filtering said injection voltage such that a portion of said fundamental frequency of said injection voltage is vectorially added to said AC source voltage.

2. The apparatus of claim 1 wherein the filter means includes a first inductor series connected with the secondary winding, and includes a second inductor connected in parallel with said series connection of said first inductor and said secondary winding, and includes a capacitor connected in parallel with said second inductor.

3. The apparatus of claim 1 wherein the filter means includes a first inductor series connected with the primary winding, and includes a capacitor connected in parallel with said primary winding, and includes a second inductor connected in parallel with the secondary winding.

4. The apparatus of claim 1 wherein the bidirectional switching means includes a pair of inverse parallel-connected thyristors.

5. The apparatus of claim 1 wherein the primary winding of the injection transformer includes an intermediate tap, said intermediate tap being connected to one of the input terminals, and wherein the bidirectional switching means includes first and second pairs of inverse parallel-connected thyristors, said first pair being connected between one end of said primary winding and the other input terminal, and said second pair of inverse parallel-connected thyristors being connected between the other end of said primary winding and said other input terminal.

6. Apparatus for stabilizing an AC voltage at high-power levels, comprising:

first and second input terminals adapted for connection to a source of AC voltage;

first and second output terminals adapted for connection to an input voltage-sensitive load, one of said output terminals being connected to one of said input terminals;

an injection transformer having first and second windings, said second winding producing an injection voltage having a fundamental frequency and harmonic frequencies thereof, said second winding being connected between the other one of said input terminals and the other one of said output terminals;

bidirectional switching means, said bidirectional switching means being serially connected with said first winding between said first and second input terminals;

control means responsive to the voltage across said first and second output terminals, said control means providing control signals for said bidirectional switching means; and filter means, said filter means having a first portion which presents a relatively high impedance to said harmonic frequencies of said injection voltage and a relatively low impedance to said fundamental frequency, and a second portion which presents a relatively high impedance to said fundamental frequency of said injection voltage and a relatively low impedance to said harmonic frequencies, said first portion of said filter means being serially connected with a predetermined one of said first and second windings of said injection transformer, said second portion of said filter means including components connected across at least one of said first and second windings of said injection transformer, and wherein said filter means and said injection transformer cooperatively produce a voltage representative of said fundamental frequency of said injection voltage which is vectorially added with said AC source voltage to provide a filtered, regulated AC voltage across said output terminals.

7. The apparatus of claim 6 wherein the first portion of the filter means includes an inductor series connected with the second winding to limit the current which flows through the bidirectional switching means.

8. The apparatus of claim 6 wherein the first portion of the filter means includes an inductor series connected with the first winding to limit the current which flows through the bidirectional switching means.

9. The apparatus of claim 6 wherein the first portion of the filter means includes a first inductor series connected with the second winding, and the second portion of said filter means includes a second inductor connected across the serially connected first inductor and second winding, and a capacitor connected across said second inductor.

10. The apparatus of claim 6 wherein the first portion of the filter means includes a first inductor series connected with the first winding, and the second portion of said filter means includes a capacitor connected across the first winding, and a second inductor connected across the second winding.

11. The apparatus of claim 6 wherein the first winding of the injection transformer includes an intermediate tap, said intermediate tap being connected to one of the input terminals, and wherein the bidirectional switching means includes first and second pairs of inverse parallel-connected thyristors, said first pair being connected between one end of said first winding and the other input terminal, and said second pair being connected between the other end of said first winding and said other input terminal.

* * * * *